US006860774B2

(12) United States Patent
Lintzner

(10) Patent No.: US 6,860,774 B2
(45) Date of Patent: Mar. 1, 2005

(54) DETACHABLE HANDLE SYSTEM FOR WATER SPORTS AND THE LIKE

(76) Inventor: Michael Louis Lintzner, P.O. Box 7622, Incline Village, NV (US) 89452

( * ) Notice: Subject to any disclaimer, the term of this patent is extended or adjusted under 35 U.S.C. 154(b) by 0 days.

(21) Appl. No.: 10/246,315

(22) Filed: Sep. 17, 2002

(65) Prior Publication Data

US 2003/0070601 A1 Apr. 17, 2003

Related U.S. Application Data

(60) Provisional application No. 60/323,187, filed on Sep. 17, 2001.

(51) Int. Cl.[7] ..... B63B 35/85
(52) U.S. Cl. ..... 441/69
(58) Field of Search ..... 441/69; 114/253; 16/110.1, 111.1, 422, 428

(56) References Cited

U.S. PATENT DOCUMENTS

| | | | | |
|---|---|---|---|---|
| 3,011,734 A | | 12/1961 | Wilkinson | |
| 3,018,474 A | * | 1/1962 | Cluck et al. | 441/69 X |
| 3,092,068 A | | 6/1963 | Brownson | |
| 3,107,937 A | * | 10/1963 | Duppengiesser | 16/422 X |
| 3,537,418 A | | 11/1970 | Brownson | |
| 3,604,388 A | * | 9/1971 | Brown et al. | 441/69 |
| 3,695,210 A | * | 10/1972 | Stein | 441/69 |
| 3,861,347 A | | 1/1975 | Christenson | |
| 3,930,460 A | | 1/1976 | Beck | |
| 4,043,290 A | | 8/1977 | Holland | |
| 4,060,049 A | | 11/1977 | Rumbaugh | |
| D248,587 S | | 7/1978 | Rumbaugh | |
| 4,182,258 A | | 1/1980 | Presser | |
| D256,038 S | | 7/1980 | Presser | |
| D256,487 S | | 8/1980 | Pittman | |
| D258,228 S | | 2/1981 | Rumbaugh | |
| D264,489 S | | 5/1982 | Holland | |
| 4,335,478 A | | 6/1982 | Pittman | |
| 4,371,352 A | | 2/1983 | Holland | |
| 4,374,638 A | | 2/1983 | Presser | |
| 4,392,833 A | | 7/1983 | Hayden | |
| 4,397,107 A | | 8/1983 | Holden | |
| 4,533,334 A | | 8/1985 | Ziomek | |
| 4,540,371 A | | 9/1985 | Taylor | |
| 4,585,420 A | | 4/1986 | Taylor | |
| D283,908 S | | 5/1986 | Ziomek | |
| 4,740,181 A | * | 4/1988 | Kell | 441/69 |
| 4,863,407 A | | 9/1989 | Casad | |
| 4,981,098 A | * | 1/1991 | Lickle | 114/253 |
| 5,052,964 A | | 10/1991 | Pittman | |
| 5,207,606 A | | 5/1993 | Pittman | |
| 5,408,221 A | * | 4/1995 | Carsella et al. | 441/69 X |
| 5,453,032 A | | 9/1995 | Crowe | |
| 5,503,580 A | | 4/1996 | McCarthy | |

FOREIGN PATENT DOCUMENTS

| | | | | |
|---|---|---|---|---|
| GB | 1227230 | * | 4/1971 | 441/69 |

* cited by examiner

*Primary Examiner*—Andrew Wright
(74) *Attorney, Agent, or Firm*—Albert W. Watkins

(57) ABSTRACT

A detachable handle system (10) includes a connector which in a first embodiment (33) pins (34) to a handle tube (21), and which in a second embodiment (433) attaches through a resilient tube (437) that is radially expanded. The detachable handle is in the preferred embodiment provided with a readily replaced handle grip (22). By detaching the handle (21) and replacing the handle grip (22), a multitude of grips may be fabricated in diverse colors and geometries for a single handle, thereby satisfying the desires of each individual user. A tow rope (35) is attached to the connector (33, 433) through a hole (36) in the connector (33) and then circumferentially about the connector (33), independent of the handle tube (21).

10 Claims, 3 Drawing Sheets

DETACHABLE HANDLE SYSTEM FOR WATER SPORTS AND THE LIKE

CROSS REFERENCE TO RELATED APPLICATIONS

This application claims priority to U.S. provisional application Ser. No. 60/323,187 filed Sep. 17, 2001, the contents which are incorporated herein in entirety.

BACKGROUND OF THE INVENTION

1. Field of the Invention

The present invention pertains generally to aquatic devices, and more particularly to tow handles such as might be used for water skiing, wake boarding and other similar activities.

2. Description of the Related Art

In the sports of water skiing, wake boarding and the like, a powered watercraft tows one or more individuals across the water. The towed individual will desirably skim across the water on a support, which may be as small as the skier's feet but which will more generally be much larger, and might, for exemplary purposes only and not to be limiting thereto, include water skis or wake boards. The support will most preferably assist with a hydro-planing effect between the water surface and the support, and in many cases will also include features such as curved leading edges that scale or overcome waves.

In order for an individual to ride upon the water surface, the towing watercraft must obtain sufficient speed to reduce the water displacement that would otherwise occur. This speed is obtained by the transfer of force through a tow rope and into a tow handle. The towed individual grasps the tow handle with one or both hands, and maintains balance upon the support. Through various body manipulations, the towed individual will typically change course generally limited by an arc defined by the length of the tow rope, but can through some maneuvers even defy the arc and travel a different path. As is known, these various body manipulations put relative large forces in unpredictable directions upon the tow handle. These forces are of course affected by the encountering of waves and similar disturbances, resulting in a need for a strong, durable and reliable tow handle.

In addition to the forces that are applied to a tow handle, tow ropes attaching to the handle will become worn and frayed through use. In order to enable a person to replace ropes, various concepts have been proposed that include end caps that both terminate the handle and also provide attachment points for the tow ropes. U.S. Pat. No. 4,060,049 by Rumbaugh; U.S. Pat. No. 4,335,478 by Pittman; U.S. Pat. No. 4,043,290 by Holland; U.S. Pat. No. 4,392,833 by Hayden; and 5,503,580 by McCarthy are exemplary. Rumbaugh, for example, illustrates molded rope anchoring flanges that are inserted into the handle tube and ultrasonically welded or adhesively bonded in place. McCarthy discloses a high durometer urethane bushing member that is glued or molecularly bonded into place.

While these patents illustrate durable and quality handles, they also prevent an individual from readily replacing the grip portion of the handle. For the amount of use required to fray the tow rope, the handle grip will also experience significant wear. Further, when an individual wishes to change the grip to a different style or color, the permanent attachment of end caps prevents or complicates replacement of the grip.

SUMMARY OF THE INVENTION

In a first manifestation, the invention is a detachable handle system comprising in combination an aquatic tow rope, a coupler, and a detachable handle. The coupler has a receiver for aquatic tow rope to which a tow rope may be fastened, and also has a longitudinal handle engaging member. A locking member is set to one of a first state or a second state and may subsequently be set to the other of the first and second states, and is reversible therebetween. In the first state, the locking member locks the coupler to the detachable handle when a separating force of a first magnitude is applied, and in a second state the locking member releases the detachable handle from coupler when the same separating force is applied.

In a second manifestation, the invention is an apparatus grasped by a person to couple to a towing watercraft. A handle has a first end, a second end, and a tubular body therebetween. A removable hand grip generally encompasses the tubular handle body. At least one end cap is coaxial with the handle tubular body and adjacent one of the ends of the handle, and has a rope receiving member. A releasable fastener couples the end cap to the handle when engaged and permits the end cap to separate from the handle otherwise.

In a third manifestation, the invention is a method of replacing a handle grip attached to an aquatic tow rope handle, comprising the steps of releasing the tow rope handle from a coupler; replacing the handle grip; engaging the tow rope handle with coupler subsequent to the replacing step; and attaching the tow rope to the coupler.

OBJECTS OF THE INVENTION

Exemplary embodiments of the present invention solve inadequacies of the prior art by providing a readily replaced handle grip. A first object of the invention is to enable a casual user to readily remove and replace a tow handle grip. A second object of the invention is to enable this replacement without compromising the reliability of the tow handle during rugged use. Another object of the present invention is to provide this additional capability through well-engineered components, thereby avoiding undesirable additional cost and complexity. A further object of the invention is to enable tow handle grip replacement and simultaneously enable simple tow rope replacement.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
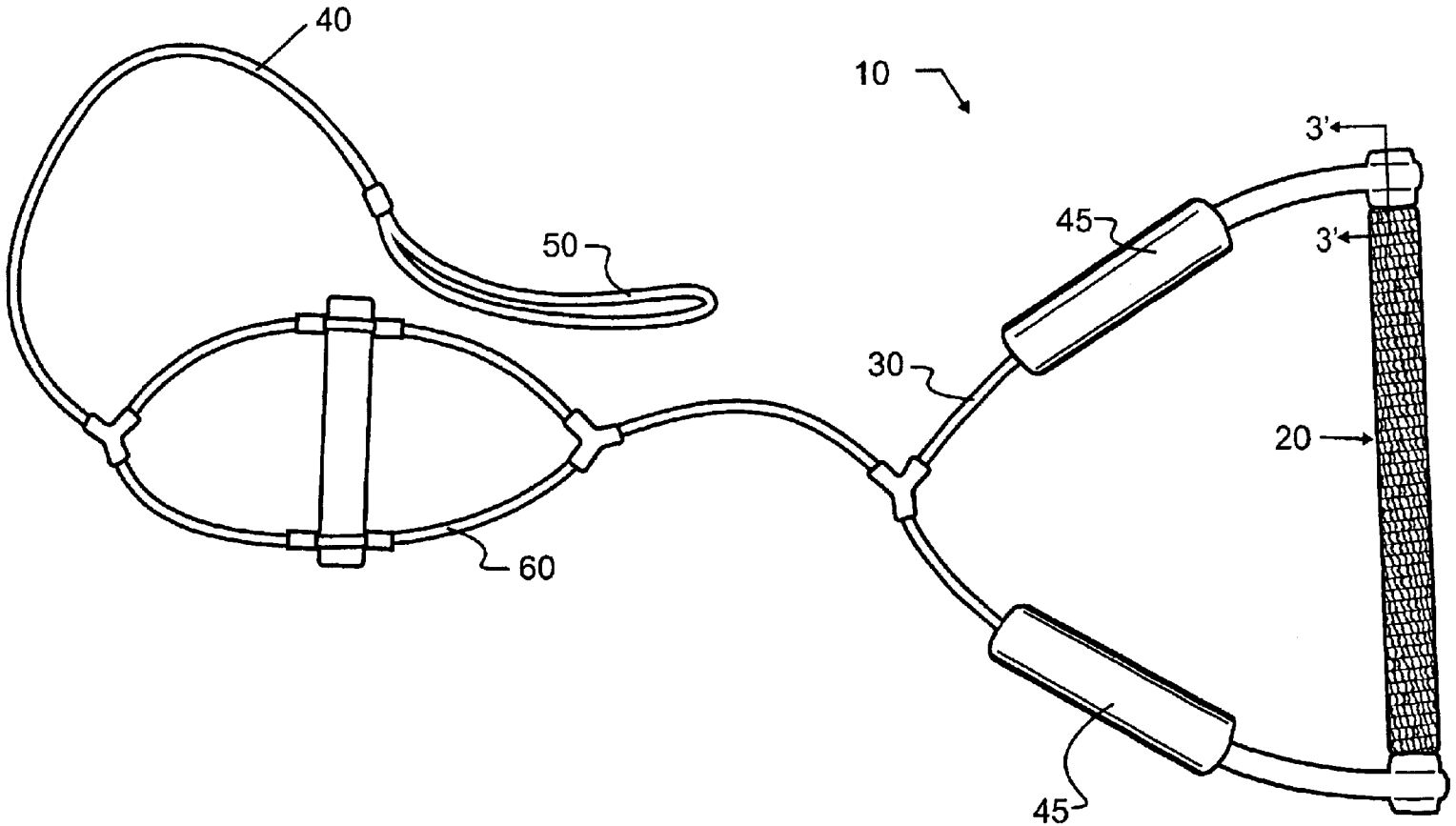
FIG. 1 illustrates a preferred embodiment tow rope and handle constructed in accord with the teachings of the invention from a top plan view.

The present invention is manifested in the preferred embodiment tow rope system 10 illustrated in FIGS. 1–4, and will find utility in sporting and recreational activities such as waterskiing, wake boarding and the like. Tow rope system 10 includes a handle 20, yoke 30, lead 40, floats 45 and attachment loop 50. In the preferred embodiment, yoke 30, lead 40 and attachment loop 50 are each fabricated from rope or other similar flaccid materials as are known and recognized in the industry. Other components maybe provided having different or complimentary function, such as a stirrup 60 and floats 45. The construction of the yoke 30, lead 40, floats 45 and loop 50 are not critical to the invention, and are illustrated herein as with stirrup 60 merely to provide a single exemplary and preferred embodiment of the invention as required by the patent statutes. Likewise, the lengths and diameters of the various components may be varied from those illustrated herein. Those skilled in the art will immediately recognize, for example, a myriad of attachment devices and methods that would each supplant attachment loop 50 for particular applications and purposes.

Figure 2:
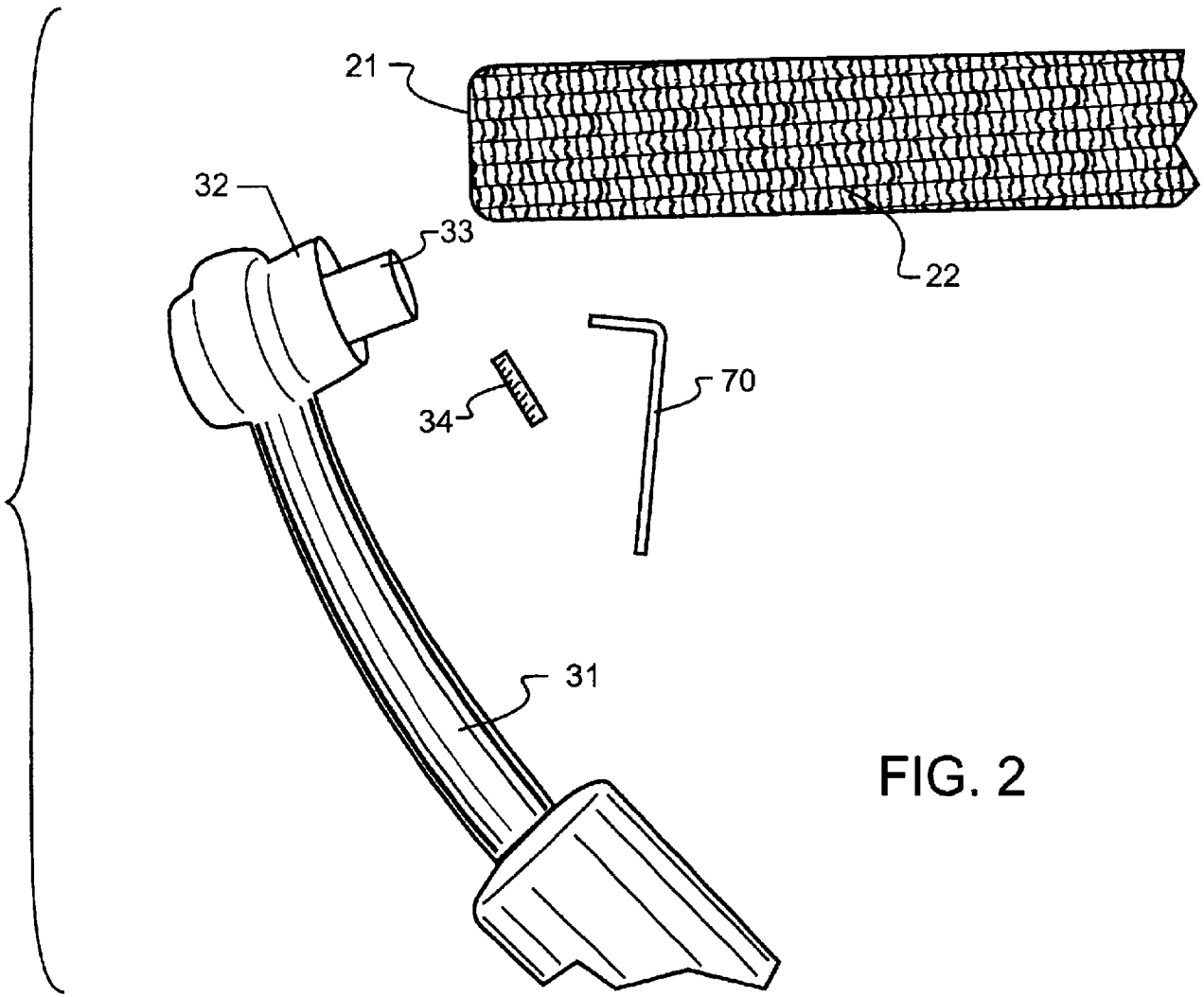
FIG. 2 illustrates a close-up top plan view of the preferred embodiment tow rope and handle of FIG. 1 partially disassembled, providing additional illustration of the features of the preferred embodiment.

FIG. 2 illustrates a closer projected view of the junction between handle 20 and yoke 30, with handle 20 and yoke 30 separated from each other. Textured handle grip 22 is also more visible therein. As is evident, yoke 30 most preferably includes a rubber or plastic boot 32 which, when coupled to handle 20, extends slightly about the end of grip 22. Boot 32 will most preferably be somewhat resilient, and sufficiently durable to withstand multiple flexures over time. Within yoke 30 and generally coaxial with boot 32 is a male connector 33 protruding therefrom. Rope 35 passes through boot 32 and then through and about connector 33, around an enlarged end 37 of male connector 33. Male connector 33 slips coaxially within tube 21, and pin 34 serves to lock the two together. Hex wrench 70 is provided in association with pin 34 as one preferred enabling technique for the coupling between tube 21 and male connector 33, though other devices and techniques which provide the necessary coupling are contemplated herein. Grip 22 is a relatively thin covering surrounding tube 21, most preferably manufactured from a soft, pliable and potentially even somewhat sticky material. While not intended to be limited thereto, and recognizing that there are too many materials to individually list, EVA is one such material which has the desired characteristics suited for the preferred embodiment EVA is available in a variety of groove patterns, colors and diameters, which allows the user a large assortment of options with one basic detachable handle system 10. Other suitable materials that provide appropriate feel and comfort may also be used, as will be apparent to those skilled in the art.

Figure 3:
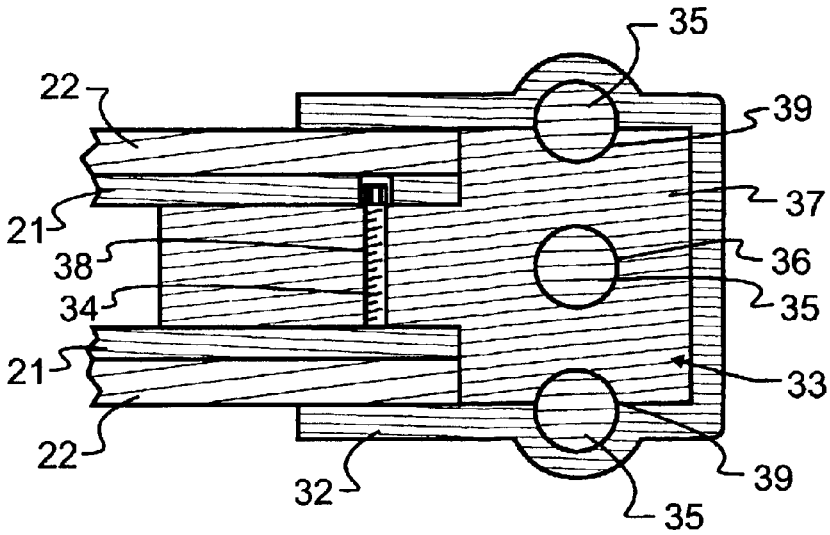
FIG. 3 illustrates a cross-sectional view of a first preferred rope to handle coupling for use with the preferred embodiment tow handle of FIG. 1, as it appears taken along section line 3' of FIG. 1.

FIG. 3 illustrates a cross-sectional view of male connector 33 and the immediately adjacent tube 21, grip 22, boot 32 and rope 35 taken along section line 3' of FIG. 1. Holes 36 and 38 may be clearly seen. Hole 36 is a smooth walled, relatively large diameter hole which permits a stringer, a loop formed at the end of the rope, to pass through. Consequently, hole 36 may preferably be approximately the same or of somewhat larger diameter than two diameters of rope 35, or rope 35 may be specially braided or woven to keep a smaller diameter in the loop region. A groove 39 may be cut in enlarged end 37 to smoothly accommodate rope 35 therein, but this is not necessary for the performance of the invention.

In contrast to hole 36, hole 38 in the preferred embodiment is relatively smaller in diameter, and will most preferably be tapped or otherwise engaging with pin 34. While pin 34 is illustrated as being threaded and turned such as through movement of hex wrench 70, the retention of male connector 33 to tube 21 is not due primarily to the threading, but is instead a pinning action, since pin 34 passes through both tube 21 and male connector 33. Consequently, there is no opportunity for pin 34 to loosen and cause a failure in this important coupling. Instead, any loosening of pin 34 will first be observable as a deformation in grip 22, and pin 34 will not reasonably be able to be removed without folding back grip 22. Unthreaded pins, countersunk bolts and nuts, and other couplings too numerous to specifically mention herein may be used to serve the function of pin 34, and the present invention is not limited to a particular pin structure or geometry.

During assembly, or re-assembly as the case may be, boot 32 will be stretched out of the way. Then rope 35 is passed through male connector 33, and then the stringer terminating rope 35 is passed around enlarged end 37 in groove 39 to prevent rope 35 from being retracted from male connector 33. Male connector 33 may, either before or after securing rope 35, be inserted into tube 21, and pin 34 screwed therein to retain tube 21 rigidly with male connector 33. Most preferably, grip 22 will either be folded or slid back from tube 21 to provide access to a small hole therein, or may alternatively have a small hole punched therethrough to allow pin 34 to pass through. Finally, boot 32 is replaced about male connector 33 and grip 22. As will now be evident, boot 32 serves to retain rope 35 in place, preventing stringer rope 35 from inadvertently loosening up and subsequently sliding off enlarged end 37. Furthermore, boot 32 encloses pin 34 and tube 21, protecting the user from any direct exposure with metal parts. Boot 32 does, of course, also provide visual trim to enhance the finished appearance of detachable handle system 10.

As should now be apparent, handle 20 may be readily detached from yoke 30, and grip 22 readily replaced. At the time of replacement, it will be conceivable to either replace both grip 22 and tube 21 or just grip 22, depending upon the requirements and intentions of the designer. The grip will most preferably be easier and less expensive to replace than the entire handle. The use of a readily replaced grip 22 enables the detachable handle system 10 to be used with diverse grips of various colors and geometries, allowing a plurality of individuals to use the same detachable handle system 10 or an individual user to change grips at will for different activities or purposes. It is contemplated that one rope may be used with many different grips that can each substitute for grip 22. Only nominal effort is required by the user to switch the grip.

Figure 4:
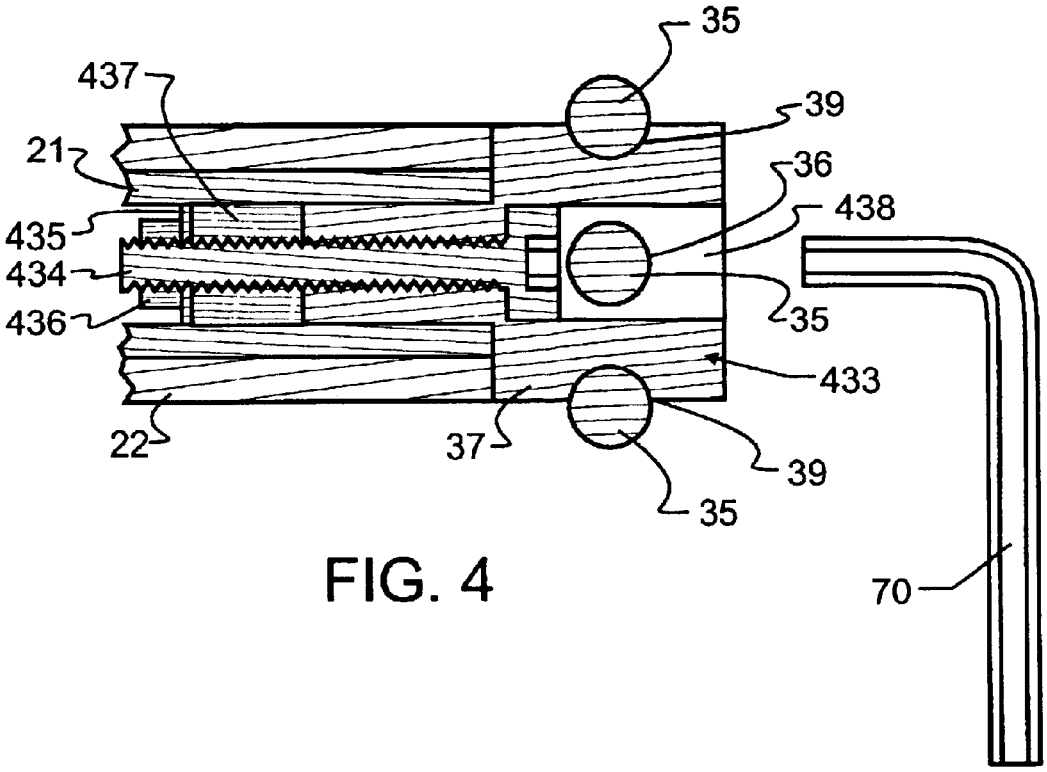
FIG. 4 illustrates a cross-sectional view of a second preferred rope to handle coupling for use with the preferred embodiment tow handle of FIG. 1, from a similar cut as that shown in FIG. 3.

FIG. 4 shows second preferred male connector 433 from the same cross-section as first preferred male connector 33, but with a different securing mechanism, and with boot 32 removed therefrom as it would be during installation. As evident therein, stringer rope 35 still passes through a transverse hole 36 and then wraps about an enlarged end 37 of male connector 433, resting in a groove 39. However, a hole 438 extends longitudinally through male connector 433, and allows socketed head bolt 434 to pass through. At the end of socketed head bolt 434 distal to hole 36 is a washer 435 and nut 436, which may be implemented as two separate components or alternatively as a single component. Between washer 435 and male connector 433 is a resilient tube 437. Tube 437 will most preferably be compressible, and, most preferably, will exhibit a relatively high coefficient of friction with tube 21. Similarly, nut 436 will most preferably exhibit sufficient friction with washer 435, or directly with tube 437.

To assemble a detachable handle system 10 using second preferred embodiment male connector 433, a person will first insert male connector 433 into tube 21, until enlarged end 37 engages with tube 21. At this point, hex wrench 70 will be inserted into hole 438, and socketed head bolt 434 will be turned to draw nut 436 towards hex wrench 70 and enlarged end 37. Once again, the use of hex wrench 70 is illustrated herein as a part of the preferred embodiment for exemplary purposes, but other tools and techniques are contemplated herein for turning bolt 434. In fact, separate rotating members may be provided specifically to turn bolt 434, and may conceivably be coaxial therewith. However achieved, the rotation of bolt 434 in turn compresses tube 437 longitudinally and causes tube 437 to expand radially. This radial expansion effects a locking action with tube 21. The resulting connection between tube 437 and tube 21 has great strength and is very reliable, owing to the relatively high coefficient of friction of tube 437, the compressive forces driving tube 437 into contact with tube 21, and the natural resilience of tube 437 to absorb severe forces. The friction between washer 435 and tube 437 prevents unintentional loosening during mechanical shock or temperature cycling. Once tube 437 has been longitudinally compressed and radially expanded, hex wrench 70 will be withdrawn, and stringer rope 35 passed through hole 36 and about groove 39. FIG. 4 illustrates the assembly at this point, though it will be understood that a boot 32 will most preferably be included also similar to that shown in FIG. 3.

In addition to the preferred male connectors 33, 433 contemplated herein, other alternatives are also contemplated. One noteworthy alternative is the use of a single direction friction fitting instead of the relatively smooth and cylindrical male end of connector 33. Care should be taken, however, to ensure that such friction fitting is designed for the forces encountered at the end of the rope, and will be able to remain attached. As should be apparent, various connectors are known in other industries that have the characteristics of durable connection while still being removable, some without the need for tools, and which, with the benefit of the present disclosure, would be obvious to artisans to use.

As already noted, the components of detachable handle system 10 maybe manufactured from a variety of materials, including metals, resins and plastics, ceramics, or even combinations of the above. The specific material used may vary, though preferences are more generally attained if the preferred embodiment is relatively light weight, durable and resistant to an environment of water or salt water spray, remains attached when in use, and is readily detached when not in use.

A variety of designs and colors have been contemplated for detachable handle system 10. The geometries and coloring may be artistic or functional. The materials used for a particular design may be chosen not only based upon the aforementioned factors such as weather resistance and weight, but may also be influenced by the particular artistic design.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

I claim:

1. A detachable handle system comprising in combination an aquatic tow rope, a coupler, and a detachable handle;

said detachable handle extending longitudinally from a first end to a second end to thereby define a longitudinal axis and having a manual gripping member therebetween;

said coupler having a receiver for said aquatic tow rope to which said aquatic tow rope may be fastened and having a longitudinal handle engaging member; and a locking member which is set to one of a first state or a second state that permits subsequent setting to the other of said first and second states and that is reversible between said first and said second states, and which in a first state locks said coupler to said detachable handle when a separating force of a first magnitude is applied between said coupler and said detachable handle, and which in a second state different from said first state releases said detachable handle from said coupler when said separating force of said first magnitude is applied, said locking member comprising a radially expandible material and a means for expanding said radially expandible material.

2. The detachable handle system of claim 1 wherein said locking member is set to a first or second state manually.

3. The detachable handle system of claim 1 wherein said coupler tow rope receiver is circumferential about said coupler.

4. The detachable handle system of claim 1 wherein said aquatic tow rope is non-destructively detachable from said receiver.

5. The detachable handle system of claim 1 wherein said expanding means comprises a means to compress said radially expandible material parallel to said longitudinal axis.

6. A method of replacing a handle grip attached to an aquatic tow rope handle, comprising the steps of:

releasing said aquatic tow rope handle from a coupler;

replacing said handle grip;

engaging said aquatic tow rope handle with said coupler subsequent to said replacing step by turning a screw and thereby radially expanding resilient material; and attaching said aquatic tow rope handle to said coupler.

7. The method of claim 6 wherein said step of attaching further comprises the steps of:

passing a tow rope through said coupler; and encompassing said tow rope about said coupler.

8. The method of claim 6 further comprising the step of moving said handle grip to obtain access to said screw, prior to said turning step.

9. The method of claim 6 wherein said step of engaging further comprises the step of inserting said coupler into said aquatic tow rope handle.

10. The method of claim 6 further comprising the steps of:

stretching a boot to reveal said coupler prior to said releasing step; and repositioning said boot about said coupler subsequent to said engaging step.

* * * * *